US005836755A

United States Patent [19]

Sheng et al.

[11] Patent Number: 5,836,755

[45] Date of Patent: Nov. 17, 1998

[54] LOCKABLE LIGHTER

[76] Inventors: Andy Sheng; Betty Sheng, both of P.O. Box 4268, Cerritos, Calif. 90703

[21] Appl. No.: 947,962

[22] Filed: Oct. 9, 1997

[51] Int. Cl.[6] ..... F23D 11/36

[52] U.S. Cl. ..... 431/153

[58] Field of Search ..... 431/153

[56] References Cited

U.S. PATENT DOCUMENTS 5,407,346 4/1995 Sher ..... 431/153
5,421,720 6/1995 Sher ..... 431/153

*Primary Examiner*—Carroll B. Dority
*Attorney, Agent, or Firm*—David and Raymond; Rayomnd Y. Chan

[57] ABSTRACT

A lockable lighter includes a fuel tank capped by a cover seat which has a fuel releasable valve communicated therethrough, a fuel lever mounted on said cover seat for operating a fuel pipe provided by the fuel releasable valve, and a flint wheel assembly adjacent the fuel lever having a flint wheel for producing spark. The cover seat has a recess subjacent the depressable platform. A blocking projection is protruded on the depressable platform underside. A catch handle comprises an insert leg vertically received in the recess and a handle extended horizontally subjacent the depressable platform of the fuel lever. The handle has a perforation into which the projection on the depressable platform is allowed to pass through. A resilient element is received in the recess and props against the insert leg for pushing the handle outwards to maintain in a lock-up position, wherein the perforation on the handle of the catch handle is displaced to stagger the aligning with the blocking projection underside the depressable platform to prevent inadvertent fuel release unless the catch handle is manipulated to a release position for permitting the fuel lever to function.

20 Claims, 7 Drawing Sheets

LOCKABLE LIGHTER

BACKGROUND OF THE PRESENT INVENTION

The present relates to disposable lighter, and more particularly to a lockable lighter having a fuel lever locking device for normally locking the fuel lever to prevent inadvertent fuel release.

Conventional disposable lighter generally comprises a fuel tank capped by a cover seat which has a fuel releasable valve communicated therethrough, a fuel lever mounted on the cover seat for operating a fuel pipe provided by the fuel releasable valve, and a flint wheel assembly adjacent the fuel lever having a flint wheel for producing spark when the flint wheel is rotated against a flint subjacent the flint wheel to ignite the fuel released through the fuel releasable valve when the fuel lever is simultaneously depressed to lift the fuel pipe.

Although the conventional disposable lighters are extensively used and extremely convenient, they are prone to some incidents of inadvertent fuel release. In fact, the fuel, commonly butane, stored in the fuel tank is under predetermined pressure, therefore the fuel may escape as gas to the environment when vented through the fuel releasable valve. This presents some risks of inadvertent ignition. Moreover, the conventional disposable lighters are operable to children. Over 30% of home fire in United States is caused by the inadequate and inadvertent operation of lighters by children.

After Jul. 1, 1994, attention has been directed to prevent ready actuation of the lighters by children who are normally not able to appreciate the potential danger of the flame. Although various safety lighters have been devised, such as U.S. Pat. Nos. 5,074,781; 5,165,886; 5,224,854; 5,240,408; 5,242,297; 4,687,437; 4,758,152; and 4,830,603, they are somewhat difficult in operation and manufacture.

SUMMARY OF THE PRESENT INVENTION

The main object of the present invention is to provide a lockable lighter which comprises a fuel lever locking device for normally locking the fuel lever in a lock-up position to prevent inadvertent fuel release unless it is manipulated to a release position for permitting the fuel lever to function.

Another object of the present invention is to provide a lockable lighter which is easy to manufacture and requires few parts.

Accordingly, the above mentioned objects are accomplished in the present invention by providing a lockable lighter comprising a fuel tank capped by a cover seat which has a fuel releasable valve communicated therethrough, a fuel lever which has a depressable platform and is mounted on a supporting frame affixed on the cover seat for operating a fuel pipe provided by the fuel releasable valve, and a flint wheel assembly adjacent the fuel lever having a flint wheel for producing spark when the flint wheel is rotated against a flint subjacent the flint wheel to ignite the released through the fuel releasable valve when the depressable platform of the fuel lever is simultaneously depressed to lift the fuel pipe.

The cover seat has a recess subjacent the depressable platform. A blocking projection is protruded on the depressable platform underside. A catch handle comprises an insert leg vertically received in the recess and a handle extended horizontally subjacent the depressable platform of the fuel lever. The handle has a perforation into which the projection on the depressable platform is allowed to pass through. A resilient element is received in the recess and props against the insert leg for pushing the handle outwards to maintain in a lock-up position, wherein the perforation on the handle of the catch handle is displaced to stagger the aligning with the blocking projection underside the depressable platform.

Therefore, in such lock-up position, the blocking projection is blocked by the periphery surface of the perforation and is unable to be depressed downwards to prevent inadvertent fuel release. Before igniting the lighter, the user must operate the catch handle to a release position, in which the handle of the catch handle is pushed inward for aligning the perforation on the handle with the blocking projection underside the depressable platform and then the handle is lifted up until the blocking projection penetrating through the perforation. In this release position, the fuel lever is depressable to allow fuel release through the fuel releasable valve. When the depressable platform of the fuel lever is depressed to lift the fuel pipe, the catch handle is pressed downward simultaneously and then the resilient element props and pushes the catch handle outwards to its original lock-up position automatically.

DETAILED DESCRIPTION OF THE PREFERRED EMBODIMENT

Figure 1:
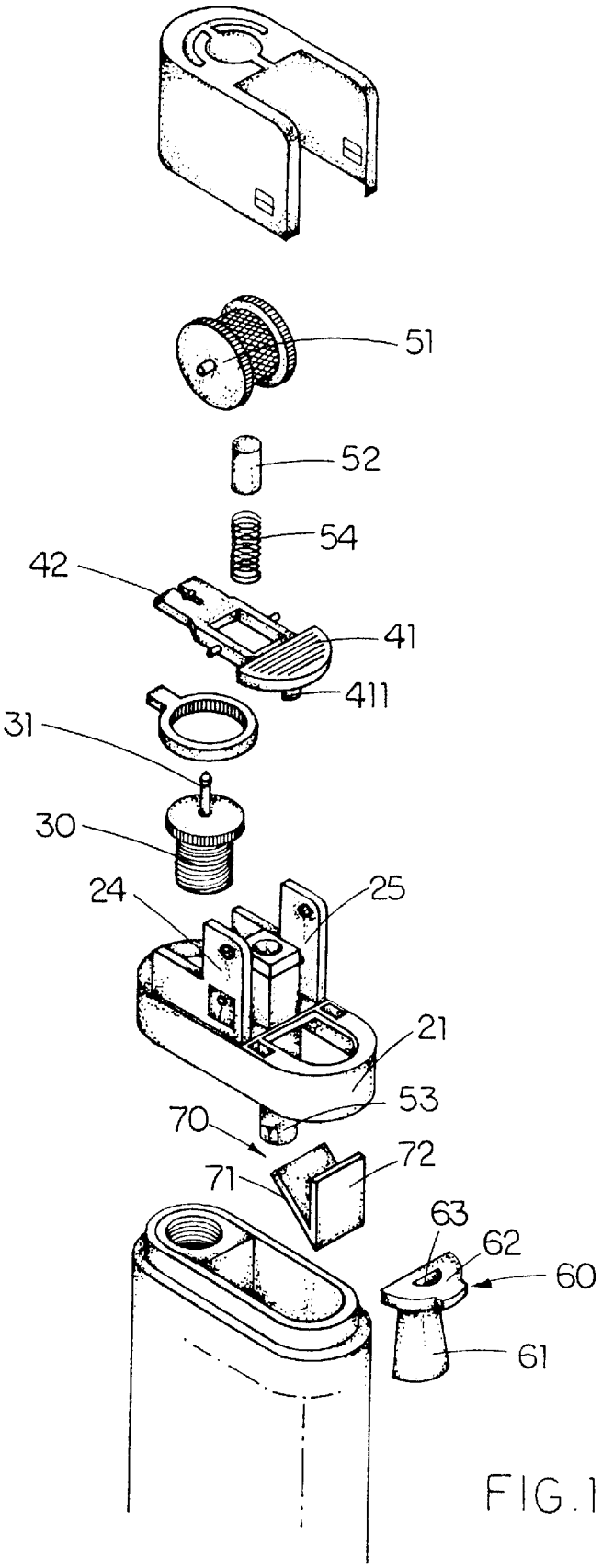
FIG. 1 is an exploded perspective view of a lockable lighter according to a preferred embodiment of the present invention.

Referring to FIGS. 1 to 4 of the drawings, a lockable lighter according to a preferred embodiment of the present invention comprises a fuel tank 10 capped by a cover seat 20 which has a fuel releasable valve 30 communicated therethrough, a fuel lever 40 which has a depressable platform 41 and is mounted on a supporting frame 21 affixed on the cover seat 20 for operating a fuel pipe 31 provided by the fuel releasable valve 30, and a flint wheel assembly 50 adjacent the fuel lever 40 having a flint wheel 51, which is rotatably mounted on the supporting frame 21, for producing spark when the flint wheel 51 is rotated against a flint 52 subjacent the flint wheel 51 to ignite the fuel released through the fuel releasable valve 30 when the depressable platform 41 of the fuel lever 40 is simultaneously depressed to lift the fuel pipe 31.

The cover seat 20 has a recess 22 subjacent the depressable platform 41. The recess 22 is divided into an inner deeper flint chamber 221 and an outer leg chamber 222. The flint wheel assembly 50 further comprises a flint tube 53, which is received in the flint chamber 22 of the recess 22, to receive a spring 54 and the flint 52, in which the flint 52 is supported by the spring 54 to prop against the flint wheel 51.

The fuel lever 40 is pivotally mounted on two parallel supporting walls 24, 25 protruded on two opposite sides of the cover seat 20. The flint wheel 51 is also rotatably mounted between the two supporting walls 24, 25. One engaging end 42 of the fuel lever 40 is engaged with the fuel pipe 31, so that when the depressable platform 41 of the fuel lever 40 is depressed, the engaging end 42 of the fuel lever 40 lifts the fuel pipe 31 for releasing fuel.

A blocking projection 411 is protruded on the depressable platform 41 underside. The lockable lighter of the present embodiment further comprises a L-shaped catch handle 60 which comprises an insert leg 61 vertically received in the recess 22 and a handle 62 extended horizontally subjacent the depressable platform 41 of the fuel lever 40. The insert leg 61 has an outer vertical flat side 611 and an inner inclined conical side 612, wherein a bottom end of the insert leg 61 has a larger sectional area than a top end of the insert leg 61. The handle 62 which is a semi-circular plate has a size generally conformed to the depressable platform 41 of the fuel lever 40. The handle 62 has a perforation 43 into which the projection 411 on the depressable platform 41 is allowed to pass through. The projection 411 has a height shorter than a distance between the bottom side of the depressable platform 41 and the top surface of the handle 62.

The lockable lighter further comprises a resilient element 70 received in the recess 22. The resilient element 70 according to the present embodiment is a generally V-shaped leaf spring made of metal or plastic. The resilient element 70 comprises a supporting piece 71 abutting against the flint tube 53 and a pressing piece 72 propping against the vertical flat side 611 of the insert leg 61 of the catch handle 60 for pushing the handle 62 outwards to maintain in a lock-up position, wherein the perforation 63 on the handle 62 of the catch handle 60 is displaced to stagger the aligning with the blocking projection 411 underside the depressable platform 40.

Figure 2:
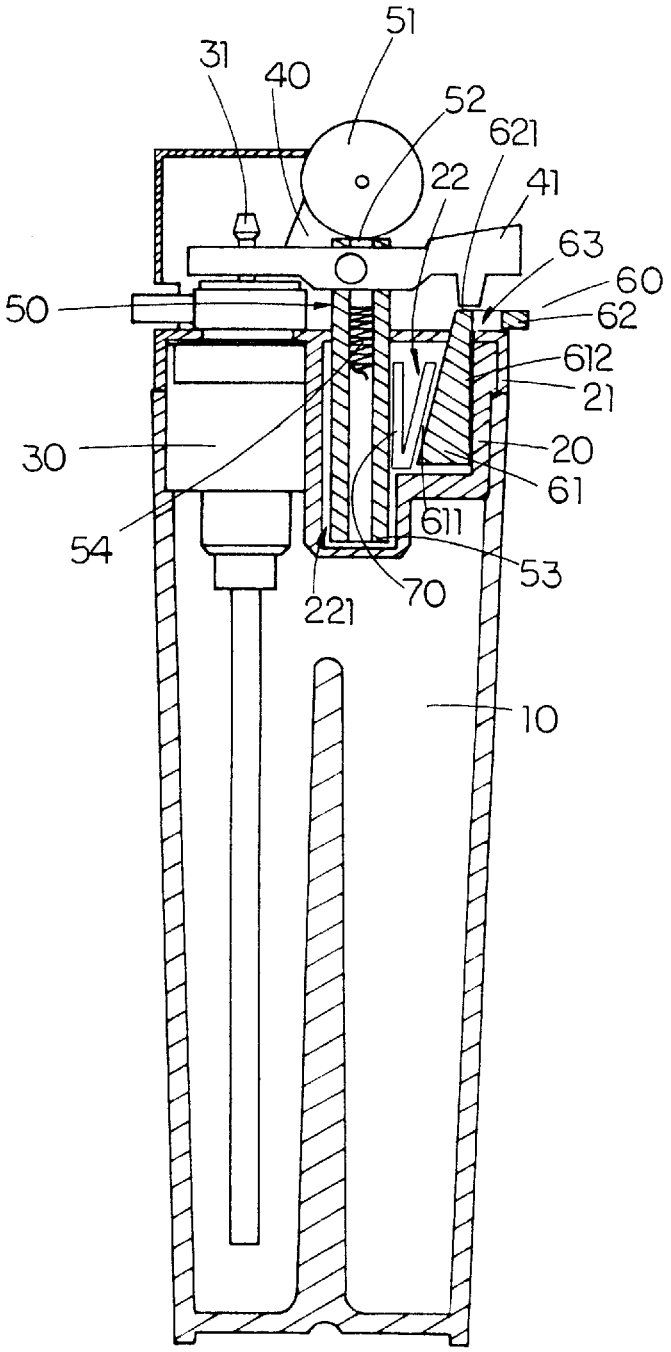
FIG. 2 is a sectional end view of the above preferred embodiment of the present invention.
Figure 3:
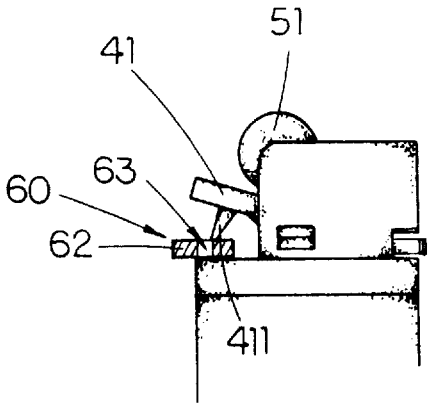
FIG. 3 is a partial end view of the above preferred embodiment of the present invention, showing the lock-up position of the catch handle.

In such lock-up position, as shown in FIGS. 2 and 3, the blocking projection 411 is blocked by a periphery surface 621 of the perforation 63 on the handle 62. Therefore, the blocking projection 411 is locked and unable to be depressed downwards to prevent inadvertent fuel release.

Figure 4:
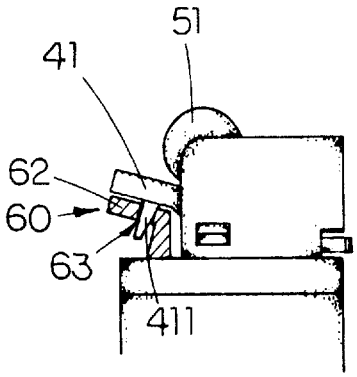
FIG. 4 is a partial end view of the above preferred embodiment of the present invention, showing the release position of the catch handle.

In order to ignite the lighter, the user must operate the catch handle 60 to a release position, in which the handle 62 of the catch handle 60 is pushed inward for aligning the perforation 63 on the handle 62 with the blocking projection 411 underside the depressable platform 41. Then the handle 62 is lifted up until the blocking projection 411 penetrating through the perforation 63, as shown in FIG. 4. In this release position, the fuel lever 40 is depressable to allow fuel release through the fuel releasable valve 30. When the depressable platform 41 of the fuel lever 40 is depressed to lift the fuel pipe 31, the catch handle 60 is pressed downward simultaneously and then the resilient element 70 props and pushes the catch handle 60 outwards to its original lock-up position automatically, as shown in FIG. 3. In other words, the lockable lighter of the present invention enables the fuel lever 40 normally maintained in the lock-up position to prevent inadvertent fuel release unless it is manipulated to the release position for permitting the fuel lever to function. In consequence, the lockable lighter of the present invention is equipped with safety locking mechanism for the fuel lever and is easy to manufacture and requires few parts.

Figure 5:
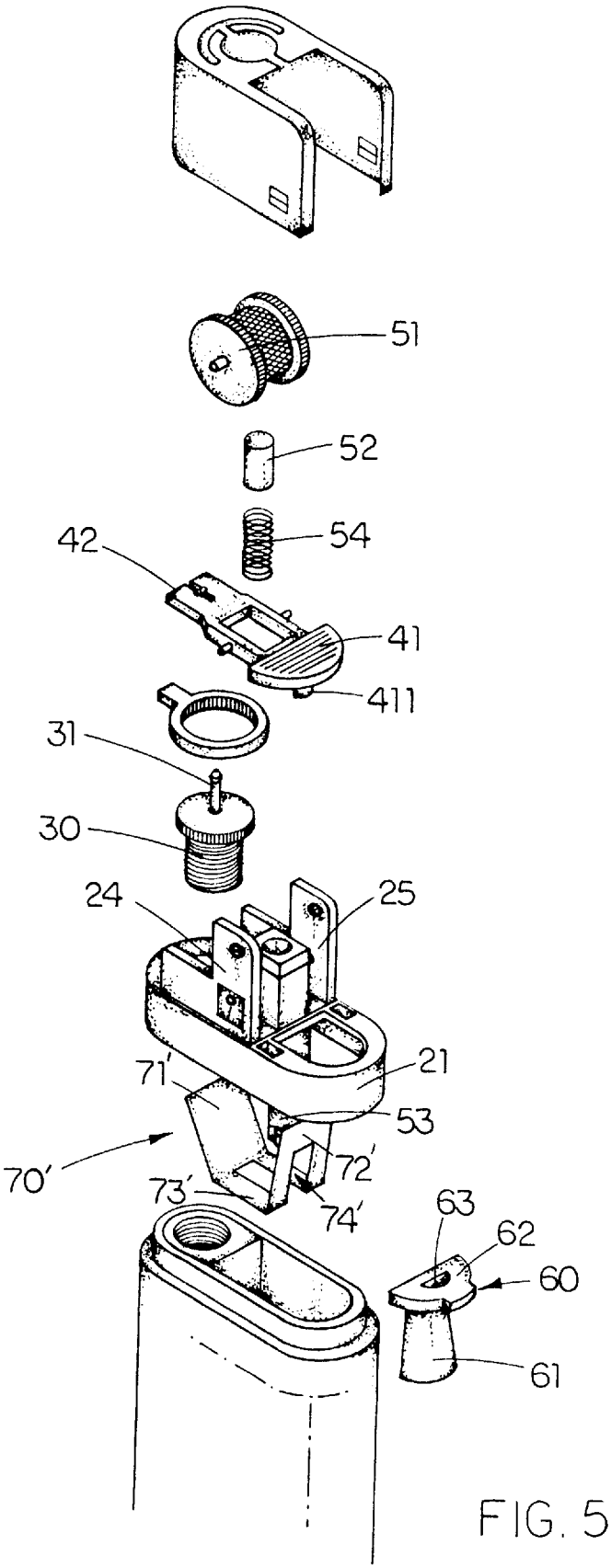
FIG. 5 is an exploded perspective view of a second preferred embodiment of the present invention.
Figure 6:
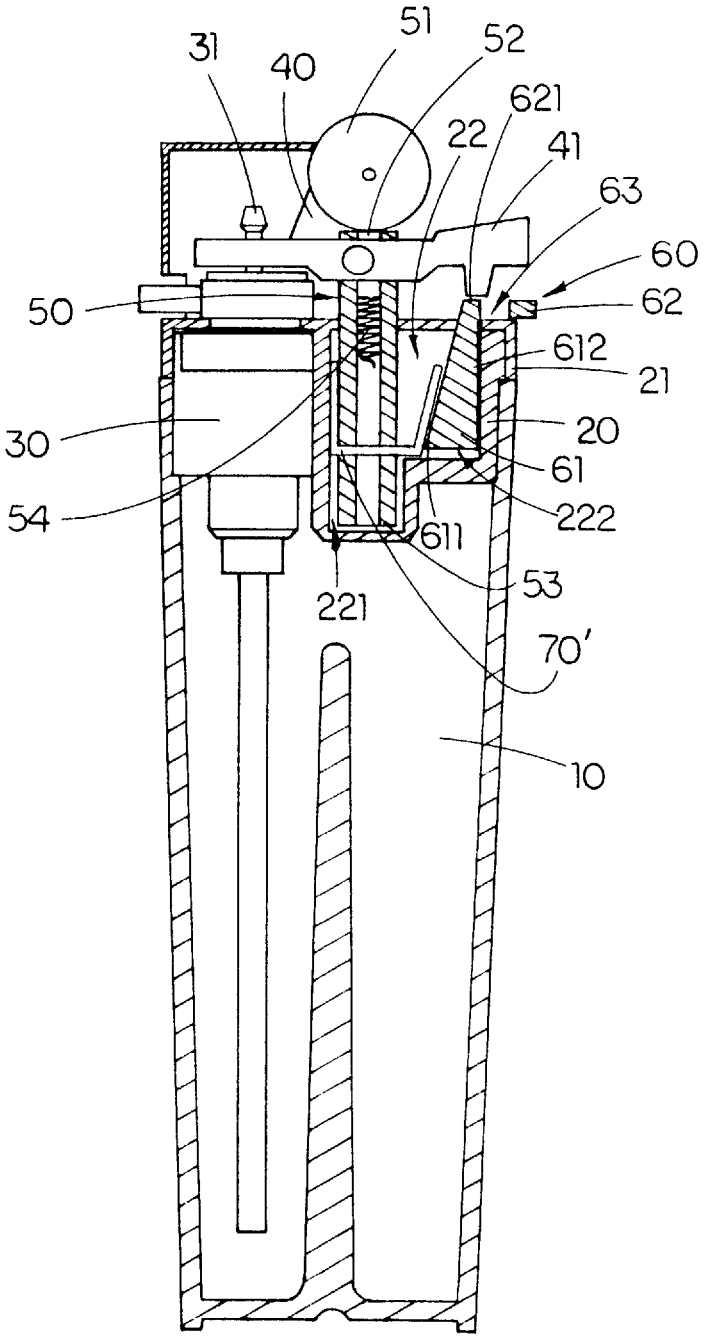
FIG. 6 is a sectional end view of the above second preferred embodiment of the present invention.

Referring to FIGS. 5 and 6, a lockable lighter according to a second preferred embodiment of the present invention is illustrated, which generally comprises the same configuration of the above first embodiment. The major modification of the second embodiment is the resilient element 70' which comprises a vertical supporting piece 71', an inclined pressing piece 72' and a connecting piece 73' integrally connected between two bottom ends of the supporting piece 71' and the pressing piece 72' respectively. On the connecting piece 73' and the pressing piece 72', a rectangular hole 74' is provided. The resilient element 70' is also received in the recess 22, wherein the flint tube 53 penetrates through the hole 74' to mounted the resilient element 70' in position. The supporting piece 71' is propped against the flint tube 53 for supporting and the pressing piece 72' is propped against the flat side 611 of the insert leg 61 for pushing the handle 62 outwards, so as to set the lockable lighter in a locking condition.

Figure 7:
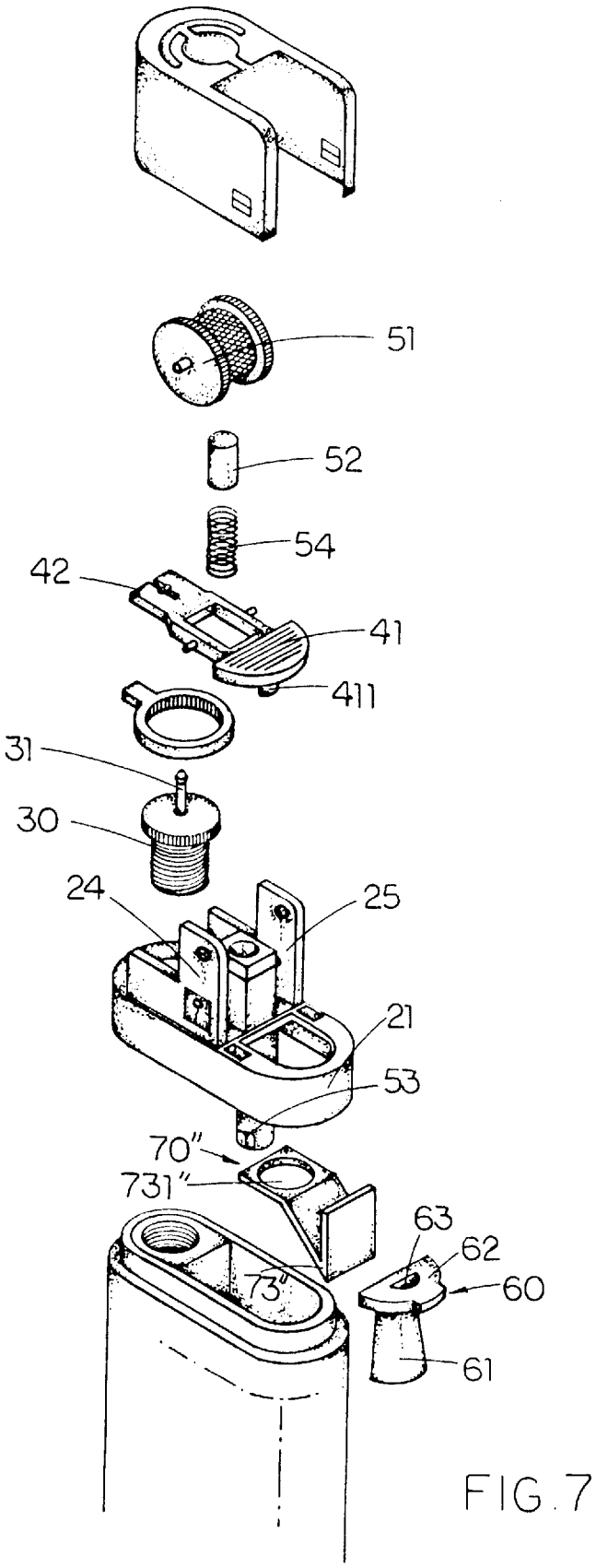
FIG. 7 is a perspective view of an alternative mode of the resilient element of the present invention.

Referring to FIG. 7, an alternative mode of the resilient element 70 disclosed in the above first embodiment is illustrated. The modified resilient element 70" further comprises a holding end portion 73" extended horizontally from the top end of the supporting piece 71. The holding end portion 73" has a supporting hole 731" thereon so that the flint tube 53 can be passed through the supporting hole 731" to further ensure fuel the resilient element 70" to be firmly supported in position. Other modifications and simple changes of the resilient element 70, such as a S-shaped or a spring like resilient element 70, may be made to the foregoing without departing from the spirit of the invention. It is therefore intended that the scope of the invention be determined solely on the claims appended hereto.

Figure 8:
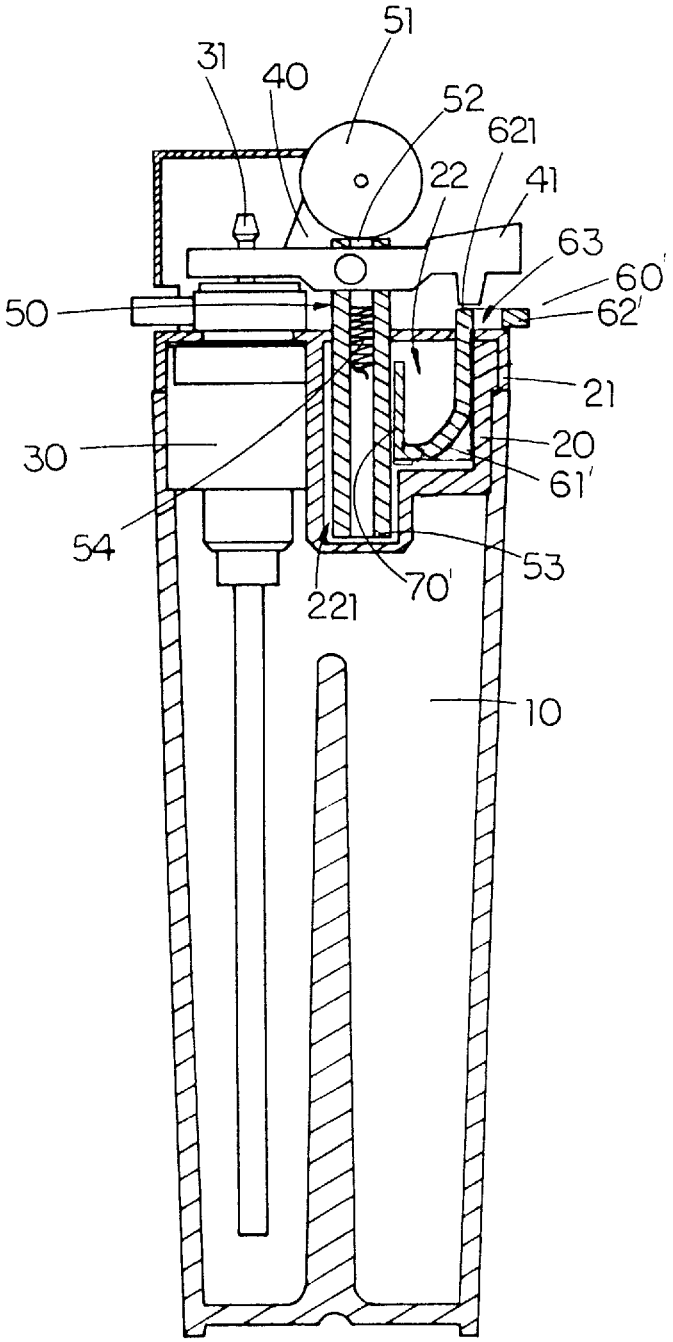
FIG. 8 is a sectional view of a third preferred embodiment of the present invention.

Referring to FIG. 8, a third preferred embodiment of the present invention is illustrates, which is an alternative mode of the above first preferred embodiment, wherein the insert leg 61 of the catch handle 60 is combined with the resilient element 70 to form an integral body. According to the third preferred embodiment, the catch handle 60' comprises an insert leg 61' is extended downwardly and outwardly from a handle 62' to form a J shape member and a supporting piece 71' integrally and vertically extended upwardly from a free end of the insert leg 61'. The supporting piece 71' is abutted against the flint tube 53 inside the recess 22, so that when the user may push in the handle 62' inwardly to the release position as shown in FIG. 4, the supporting piece 71' supports the insert leg 61' to tend to return to its original lock-up position. Therefore, when the pushing force applied to the handle 62' releases, the handle 62' will return to its lock-up position as shown in FIG. 3.

What is claimed is:

1. A lockable lighter, comprising a fuel tank capped by a cover seat which has a fuel releasable valve communicated therethrough, a fuel lever which has a depressable platform and is mounted on a supporting frame affixed on said cover seat for operating a fuel pipe provided by said fuel releasable valve, and a flint wheel assembly adjacent said fuel lever having a flint wheel for producing spark when said flint wheel is rotated against a flint subjacent said flint wheel to ignite said fuel released through said fuel releasable valve when said depressable platform of said fuel lever is depressed to lift said fuel pipe, in which said cover seat has a recess provided subjacent said depressable platform;

a blocking projection being protruded on said depressable platform underside;

a catch handle comprising an insert leg vertically received in said recess and a handle extended horizontally subjacent said depressable platform of said fuel lever, said handle having a perforation into which said blocking projection on said depressable platform is allowed to pass through; and a resilient element which is received in said recess and props against said insert leg for pushing said handle outwards to a lock-up position, wherein said perforation on said handle of said catch handle is displaced to stagger said aligning with said blocking projection underside said depressable platform, whereby said blocking projection is blocked by a periphery surface of said perforation on said handle and is unable to be depressed downwards to prevent inadvertent fuel release; moreover, to ignite said lockable lighter, said catch handle being operated to a release position, in which said handle of said catch handle is pushed inward for aligning said perforation on said handle with said blocking projection on the underside of said depressable platform, and then said handle is lifted up until said blocking projection penetrating through said perforation, therefore said fuel lever is depressable to allow fuel release through said fuel releasable valve, and that when said depressable platform of said fuel lever is depressed to lift said fuel pipe, said catch handle is pressed downward simultaneously, in which said resilient element props and pushes said catch handle outwards to the lock-up position automatically.

2. A lockable lighter as recited in claim 1 in which said insert leg has an outer vertical flat side and an inner inclined side, wherein a bottom end of said insert leg has a larger sectional area than a top end of said insert leg.

3. A lockable lighter as recited in claim 2 in which said flint wheel assembly further comprises a flint tube to receive a spring and said flint, one end of said resilient element being abutted against said flint tube while another end of said resilient element being propped against said flat side of said insert leg of said catch handle.

4. A lockable lighter as recited in claim 3 in which said handle which is a semi-circular plate having a size generally conformed to said depressable platform of said fuel lever.

5. A lockable lighter as recited in claim 3 in which said recess has an inner flint chamber for receiving said flint tube and an outer leg chamber for receiving said resilient element and said insert leg of said catch handle.

6. A lockable lighter as recited in claim 1 in which said resilient element is a generally V-shaped leaf spring which comprises a supporting piece and a pressing piece propping against said insert leg of said catch handle for pushing said handle outwards to maintain in the lock-up position, wherein said perforation on said handle of said catch handle is displaced to stagger the aligning with said blocking projection underside said depressable platform.

7. A lockable lighter as recited in claim 6 in which said insert leg has an outer vertical flat side and an inner inclined side, wherein a bottom end of said insert leg has a larger sectional area than a top end of said insert leg.

8. A lockable lighter as recited in claim 7 in which said flint wheel assembly further comprises a flint tube to receive a spring and said flint, said supporting piece of said resilient element being abutted against said flint tube and said pressing piece of said resilient element being propped against said inclined side of said insert leg of said catch handle.

9. A lockable lighter as recited in claim 8 in which said handle which is a semi-circular plate having a size generally conformed to said depressable platform of said fuel lever.

10. A lockable lighter as recited in claim 8 in which said recess has an inner flint chamber for receiving said flint tube and an outer leg chamber for receiving said resilient element and said insert leg of said catch handle.

11. A lockable lighter as recited in claim 6 in which said resilient element further comprises a holding end portion extended horizontally from the top end of the supporting piece, said holding end portion having a supporting hole thereon.

12. A lockable lighter as recited in claim 11 in which said flint wheel assembly further comprises a flint tube to receive a spring and said flint, said flint tube being passed through said supporting, hole of said holding end portion of said resilient element to further ensure said resilient element to be firmly supported in position.

13. A lockable lighter as recited in claim 12 in which said insert leg has an outer vertical flat side and an inner inclined side, wherein a bottom end of said insert leg has a larger sectional area than a top end of said insert leg and said pressing piece of said resilient element is propped against said inclined side of said insert leg of said catch handle.

14. A lockable lighter as recited in claim 13 in which said handle which is a semi-circular plate having a size generally conformed to said depressable platform of said fuel lever.

15. A lockable lighter as recited in claim 14 in which said recess has an inner flint chamber for receiving said flint tube and an outer leg chamber for receiving said resilient element and said insert leg of said catch handle.

16. A lockable lighter as recited in claim 1 in which said resilient element comprises a vertical supporting piece, an inclined pressing piece and a connecting piece integrally connected between two bottom ends of said supporting piece and said pressing piece respectively, wherein on said connecting piece and said pressing piece, a rectangular hole is provided.

17. A lockable lighter as recited in claim 16 in which said flint wheel assembly further comprises a flint tube to receive a spring and said flint, so that said flint tube of said flint wheel assembly is penetrated through said hole to mount said resilient element in position.

18. A lockable lighter as recited in claim 17 in which said insert leg has an outer vertical flat side and an inner inclined side, wherein a bottom end of said insert leg has a larger sectional area than a top end of said insert leg, said pressing piece of said resilient element being propped against said inclined side of said insert leg, and that said handle which is a semi-circular plate has a size generally conformed to said depressable platform of said fuel lever.

19. A lockable lighter as recited in claim 18 in which said recess has an inner flint chamber for receiving said flint tube and an outer leg chamber for receiving said resilient element and said insert leg of said catch handle.

20. A lockable lighter as recited in claim 1 in which said insert leg of said catch handle is combined with said resilient element to form an integral body, wherein said insert leg is extended downwardly and outwardly from a handle to form a J shape member and said resilient element comprises a supporting piece integrally and vertically extended upwardly from a free end of said insert leg, said supporting piece being abutted against said flint tube inside said recess, so that when said handle is pushed inwardly by a pushing force to said release position, said supporting piece supports said insert leg to tend to return to said lock-up position, therefore when said pushing force applied to said handle is released, said handle will return to said lock-up position.

* * * * *